US006485337B2

(12) United States Patent
Hsieh

(10) Patent No.: US 6,485,337 B2
(45) Date of Patent: Nov. 26, 2002

(54) ELECTRICAL CONNECTOR

(75) Inventor: Shao C. Hsieh, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/935,072

(22) Filed: Aug. 22, 2001

(65) Prior Publication Data

US 2002/0025732 A1 Feb. 28, 2002

Related U.S. Application Data

(60) Provisional application No. 60/228,992, filed on Aug. 30, 2000.

(51) Int. Cl.[7] ..... H01R 13/187; H01R 11/03

(52) U.S. Cl. ..... 439/845; 439/790; 439/843

(58) Field of Search ..... 439/845, 843, 439/842, 884, 879, 790, 284–287, 290, 291

(56) References Cited

U.S. PATENT DOCUMENTS 5,588,884 A * 12/1996 Rudoy et al. ..... 439/787

5,911,605 A * 6/1999 Woolridge et al. ..... 439/790

* cited by examiner

*Primary Examiner*—Khiem Nguyen
*Assistant Examiner*—Chandrika Prasad
(74) *Attorney, Agent, or Firm*—Thomas N. Twomey

(57) ABSTRACT

An electrical connector utilizing two elongated terminals each having dual contact blades extending laterally from an elongated support section forming a U-shaped cross section. A recess for each terminal is defined by the respective dual contact blades and support sections The first blade of the dual blades for the first terminal mates within the recess of the second terminal and the first blade of the dual blades for the second terminal mates within the recess of the first terminal. A laterally bisected S-shaped insert device engages electrically between the blades of the terminals. The insert device comprises a first and a second member each having a series of inward bent ribs for engaging the adjacent blades. The ribs extend in the same direction as the mating movement of the opposing terminal. An arrangement of tangs and prongs of each member hold and lock the insert device within the recesses by engaging the leading and trailing edges of the blades of each terminal.

14 Claims, 3 Drawing Sheets

ELECTRICAL CONNECTOR

This application claims the benefit of U.S. Provisional Application No. 60/228,992 filed Aug. 30, 2000, the disclosures of which are incorporated herein by reference in their entirety as if set forth at length.

TECHNICAL FIELD

This invention relates generally to an electrical connector, and more particularly to a dual bladed terminal electrical connector for high power connectors of the type used in automotive vehicle batteries, power electronics, alternators, electric motors and the like.

BACKGROUND OF THE INVENTION

High power electrical connectors are often made in-part by a machining process because the electrical contacts are made of a solid brass rod. Stamping, however, is the preferred manufacturing process because the electrical connectors can be made at reduced cost and higher volume. Rudoy et al. U.S. Pat. No. 5,588,884, incorporated herein by reference, discloses one such high power connector utilizing one elongated male terminal with dual blades extending axially and another S-shaped terminal, wherein the terminals mate from an axial direction. To improve electrical contact for high power applications, U-shaped inserts directly engage between the mating surfaces of the two terminals. The inserts have a series of twisted ribs having edges that resiliently engage the terminals.

The terminals in the Rudoy '884 reference can only be mated from one direction, thereby limiting versatility. More generally, present stamped terminals are expensive and difficult to manufacture often requiring special tools to assemble. What is needed is a terminal connector which lends itself to normal processing methods, can be made at a lower tooling cost, has a limited number of differing parts, and permits more convenient or multi-directional mating of the terminal parts with one another.

SUMMARY OF THE INVENTION

A high power electrical connector utilizing two elongated terminals each having dual contact blades extending laterally from an elongated support section forming a U-shaped cross section. A recess for each terminal is defined by the respective dual contact blades and support sections The first blade of the dual blades for the first terminal mates within the recess of the second terminal and the first blade of the dual blades for the second terminal mates within the recess of the first terminal. A laterally bisected S-shaped insert device engages electrically between the blades of the terminals. The insert device comprises a first and a second member each having a series of inward bent ribs acting as depressable leaf springs for engaging the adjacent blades. The ribs extend in the same direction as the mating movement of the opposing terminal. An arrangement of tangs and prongs of each member hold and lock the insert device within the recesses by engaging the leading and trailing edges of the blades of each terminal.

An advantage of the present invention is a high current, high power, electrical connector manufactured by a stamping process at high volume and low tooling cost.

Yet another advantage of the present invention is a versatile design providing consistent product performance with a reduction of differing parts.

Still further, an advantage of the present invention is a connector which does not require tools to assemble prior to mating.

BRIEF DESCRIPTION OF THE DRAWINGS

The presently preferred embodiments of the invention are disclosed in the following description and accompanied drawings wherein.

DETAILED DESCRIPTION OF THE PREFERRED EMBODIMENTS

Figure 1:
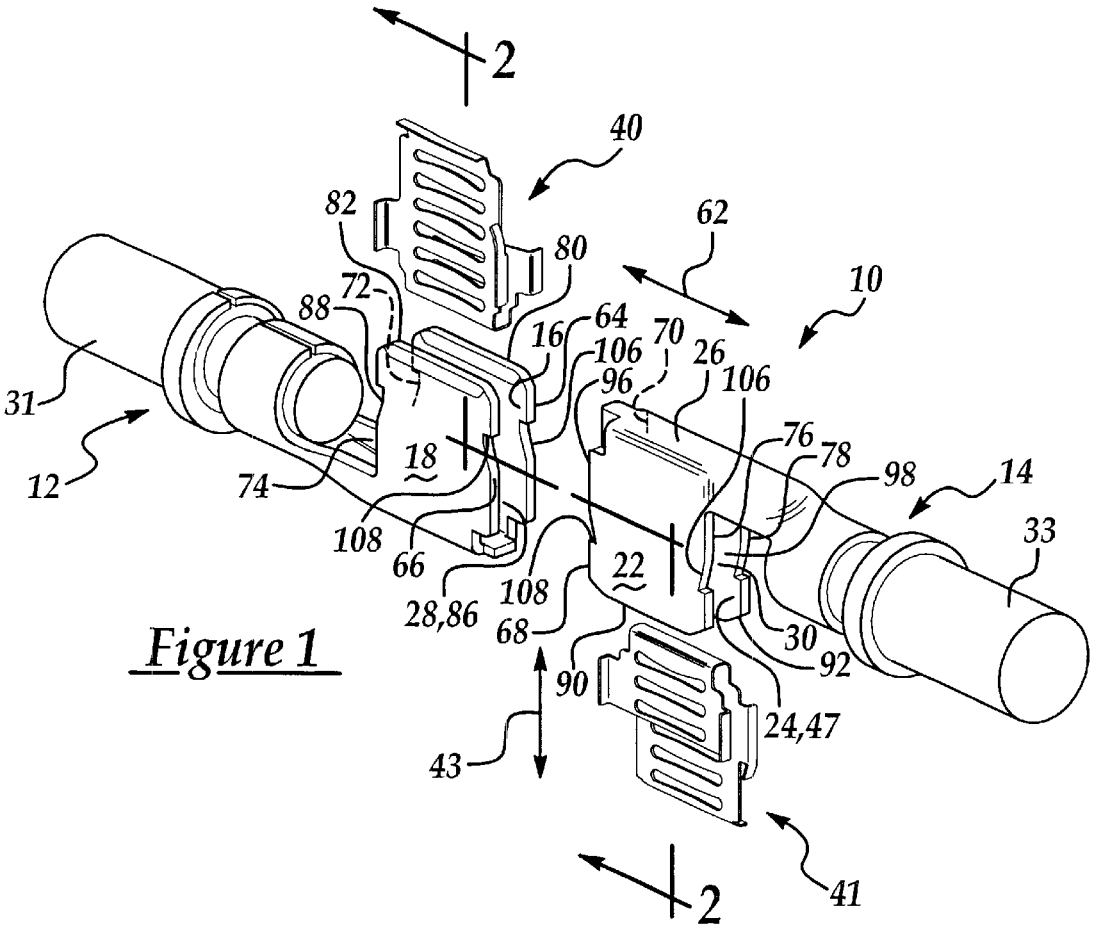
FIG. 1 is an exploded perspective view of an electrical connector constructed in accordance with the invention.

Referring to FIGS. 1–4, an electrical connector 10 is shown having a dual bladed first terminal 12 and a substantially identical mating second terminal 14. The dual blades of the first terminal 12 are identified as a first blade 16 and a second blade 18, both projecting laterally outward with respect to the elongated first terminal 12 from an elongated support section 20. Likewise, the second terminal 14 has first and second blade 22, 24 which project laterally outward from a support section 26. The first and second blades 16, 18 of the first terminal 12 are substantially parallel to one another, and when combined with the support section 20, define inwardly a recess 28. Likewise, the first and second blades 22, 24 of the second terminal 14 also form a recess 30. When the terminals are mated, the first blade 16 of the first terminal 12 resides within the recess 30 of the second terminal 14 and the first blade 22 of the second blade 14 resides within the recess 28 of the first terminal 12. At least one insulated wire 31 is engaged electrically or crimped at the trailing end of terminal 12, and likewise, at least one insulated wire 33 is engaged to the trailing end of terminal 14. Both wires 31, 33 extend longitudinally with respect to the terminals 12, 14 and in opposite directions to each other.

Figure 2:
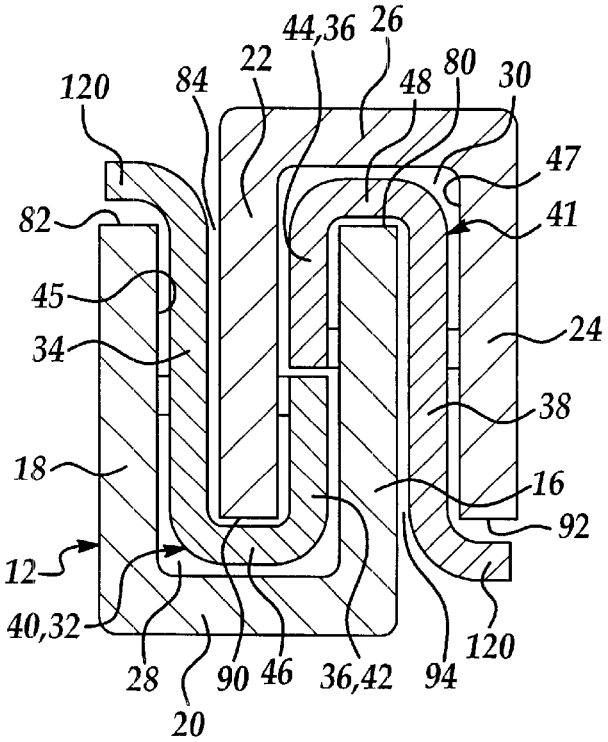
FIG. 2 is a cross section view of the connector taken along line 2—2 viewing in the direction of the arrows of FIG. 1.

Electrically engaging directly between the blades of the first and second terminals 12, 14 is a woven insert device 32 having a substantially S-shaped cross section, as best shown in FIG. 2. Insert device 32 has a first leg 34, an intermediate leg 36 and a second leg 38 all three disposed substantially parallel to one-another. The first leg 34 is engaged electrically between the second blade 18 of the first terminal 12 and the first blade 22 of the second terminal 14. The intermediate leg 36 is engaged electrically between the first blade 22 of the second terminal 14 and the first blade 16 of the first terminal 12. And, the second leg 38 of the insert device 32 is engaged electrically between the first blade 16 of the first terminal 12 and the second blade 24 of the second terminal 14.

To simplify and reduce costs of manufacturing, the insert device 32 is divided into two substantially identical separate components, identified as first and second members 40, 41. During assembly, the first and second members are inserted and locked into their respective recesses 28, 30 from a laterally direction 43, as best shown in FIG. 1. The first member 40 comprises the first leg 34 and an intermediate portion 42 of the intermediate leg 36. The second member 44 of the insert device 32 comprises the second leg 38 and an intermediate portion 44 of the intermediate leg 36. The two intermediate portions 42, 44 are co-planar and substantially similar in dimensions, and together comprise the intermediate leg 36. Connecting the first leg 34 to the intermediate portion 42 is a base 46 of the first member 40. After assembly, the base 46 is disposed adjacent to and preferably electrically engages the support section 20, and the outward side of the first leg 34 electrically engages an inward face 45 of the second blade 18 of the first terminal 12. The second member 41 also has a base 48 engaged between the intermediate portion 44 and the second leg 38. The base 48 electrically engages the support section 26, and the outward side of the second leg 38 electrically engages an inward surface 47 of the second blade 24 of the second terminal 14.

Referring to the first and second members 40, 41 are elongated and substantially similar to one another, bending along the contours of the respective recess. The perimeter of each member 40, 41 is substantially defined by connecting; intermediate edge 50, end edge 52, side edge 54 and opposite side edge 56. Each member extends lengthwise from the intermediate edge 50 to the end edge 52. The side edge 54 is disposed substantially parallel to the opposite side edge 56 and together generally define laterally each member 40, 41. The intermediate portions 42, 44 of the respective members 40, 41 project substantially transversely from the respective bases 46, 48 to the intermediate edges 50. The first and second legs 34, 38 are defined longitudinally between the end edges 52 and the respective bases 46, 48 of the first and second members 40, 41. The intermediate portions 42, 44 and the first and second legs 34, 38 have a series of ribs 58 which substantially extend laterally with respect to the member, or longitudinally with respect to the terminals 12, 14. A series of slits or slots 60 are aligned side-by-side, each slot alternating between each rib 58. The ribs 58 are bent inwardly at the centers, thereby projecting slightly into the respective recesses 28, 30 to improve the electrical engagement of the mating blades of the first and second terminals 12, 14. The positioning of the ribs 58 promote mating of the first and second terminals 12, 14 because the longitude of the ribs 58 are substantially collinear with a mating direction 62 of the terminals.

Referring to FIGS. 1 and 2, to maximize electrical contact, the width of the first and second members 40, 41, or the distance between the side edge 54 and the opposite side edge 56, is substantially equal to the width of the blades 16, 18, 22, 24, or distance between the leading edges 64, 66, 68, 70 and the respective trailing edges 72, 74, 76, 78 of the respective first and second blades 16, 18, 22, 24 of the first and second terminals 12, 14. A longitudinal edge 80 extends between the leading edge 64 and the trailing edge 72 of the first blade 16 of the first terminal 12, and a longitudinal edge 82 extends between the leading edge 66 and the trailing edge 74 also of the first terminal 12. Defined between the longitudinal edges 80, 82 is a longitudinal opening 84 to the recess 28. Defined between the leading edges 64, 66 is a leading opening 86 to the recess 28. Likewise, defined between the trailing edges 72, 74 is a trailing opening 88 to the recess 28. The leading opening 86 is substantially parallel to the trailing opening 88, and both are substantially perpendicular to the longitudinal opening 84.

Like the first terminal, the longitudinal edge 90 of the first blade 22 of the second terminal 14 extends between the leading edge 68 and the trailing edge 76. The longitudinal edge 92 extends between the leading edge 70 and the trailing edge 78 of the second blade 24 of the second terminal 14. A longitudinal opening 94 is defined between the longitudinal edges 90, 92 to the recess 30. A leading opening 96 is defined between the leading edges 68, 70 to the recess 30, and a trailing opening 98 is defined between the trailing edges 76, 78 to the recess 30. During mating of the terminals 12, 14, the first blade 22 of the second terminal 14 moves through the leading opening 86 and into the recess 28 of the first terminal 12. Incidentally, the first blade 16 of the first terminal 12 moves through the leading opening 96 of the second terminal 14 and into the recess 30.

Figure 3:
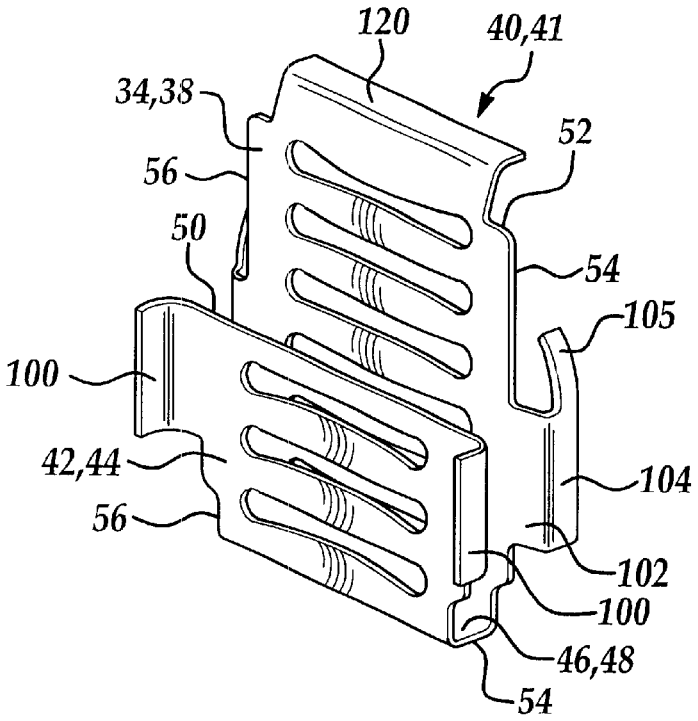
FIG. 3 is an enlarged perspective view of a member of the connector.
Figure 4:
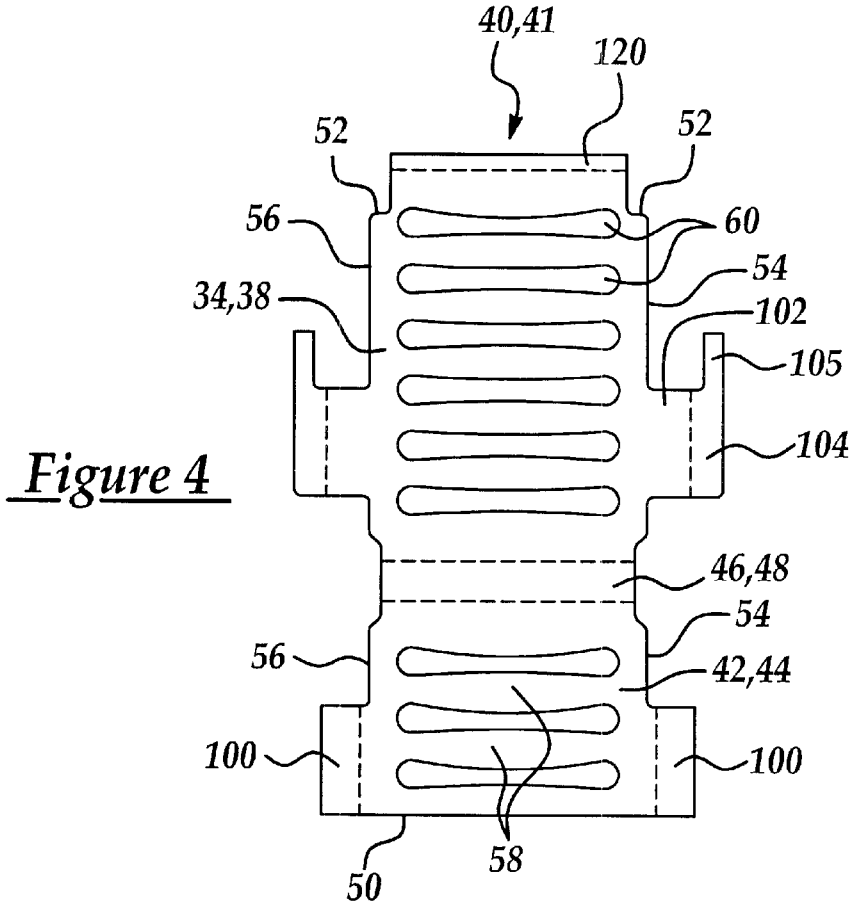
FIG. 4 is a blank view of the member.

During assembly of the terminals, the first member 40 of the insert device 32 is inserted into the first terminal 12 from the lateral direction 43 and through the longitudinal opening 84 until the bases 46, 48 are adjacent to the respective support sections 20, 26 of the first and second terminals 12, 14. Each of the first and second member 40, 41 have two tangs 100, one projecting outward from the side edge 54 and engaged to the intermediate portion 42 and the other tang 100 is objecting outward from the opposite side edge 56 of the intermediate portion 42 as best shown in FIGS. 3 and 4. The tangs 100 are bent outward with respect to the first or second member 40, 41 in order to engage the leading and trailing edges of the terminal blades. The tangs 100 of the first member 40 engage the leading and trailing edges 64, 72 of the first blade 16 of the first terminal 12 and the tangs 100 of the second member 41 engage the leading and trailing edges 68, 76 of the first blade 22 of the second terminal 14. The tangs 100 thereby prevent movement of the insert device 32 in the longitudinal direction 62 during mating of the terminals.

The first and second legs 34, 38 of the insert device 32 each have two tabs 102 projecting outward from the side edge 54 and opposite side edge 56. Projecting transversely outward from the distal end of each tab 102 is a prong 104. Each prong 104 extends laterally outward with respect to the terminal and away from the respective base 46, 48. A cantilevered end portion 105 of each prong 104 bends slightly inward toward the respective first and second legs 34, 38. When the first and second members 40, 41 are inserted into the respective first and second terminals 12, 14, the end portions 105 of the resilient prongs 104 are forced outward as they slide along the respective leading and trailing edges 66, 74 of the first terminal 12 and leading edge 70 and trailing edge 78 of the second blade 24 of the second terminal 14, until the prongs 104 snap into notches 106 defined by the leading edges 64, 66, 68, 70 and the trailing edges 72, 74, 76, 78. Each notch 106 extends into each respective blade and thereby forms a shelf surface 108 which faces the respective support section of the first and second terminals 12, 14. The prongs 104 assure that the first and second members 40, 41 will not separate from their respective first and second terminals 12, 14.

A flap 120 of each first and second member 40, 41 protects the longitudinal edge 84, 92 of the respective first and second terminal 12, 14. The flap 120 extends unitarily from the end edge 82, 84 of the respective first and second members 40, 41, and projecting outward therefrom, substantially covering the longitudinal edges 84, 92.

Figure 5:
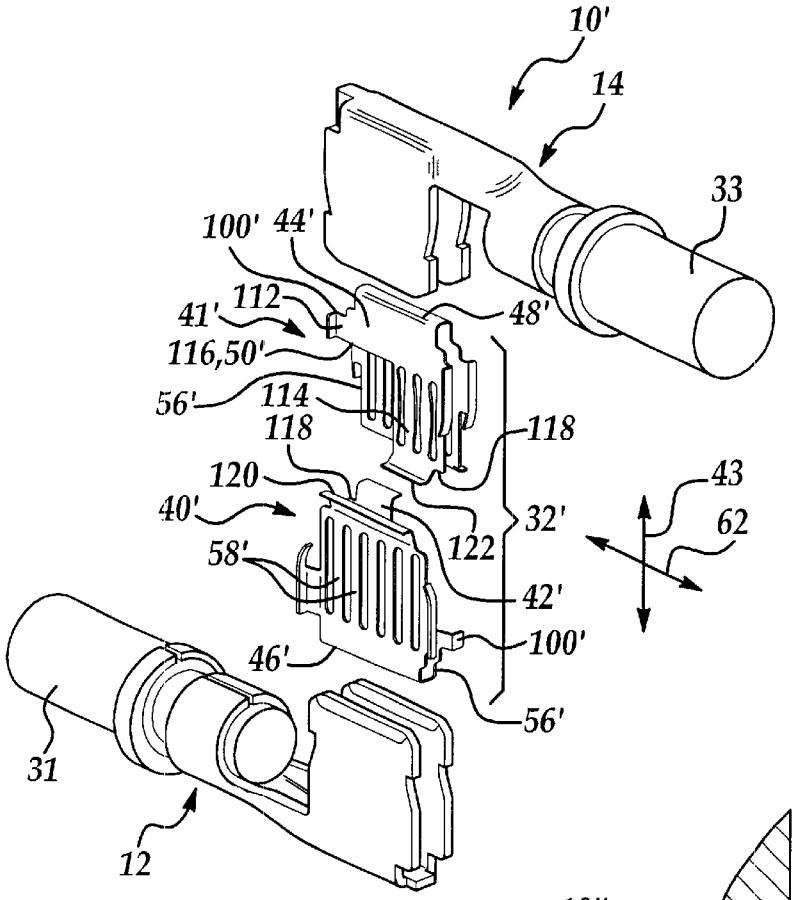
FIG. 5 is an exploded perspective view of a second embodiment of an electrical connector.

Referring to FIG. 5, a second embodiment of an insert device 32' of the present invention is shown wherein an electrical connector 10', utilizing the same terminals 12, 14 as the first embodiment, mates not from the longitudinal direction 62 as in the first embodiment but from the lateral direction 43. Consequently, a series of ribs 58' of the insert device 32' extend in the lateral direction 43 or longitudinally with respect to the first and second members 40', 41' and not laterally as in the first embodiment. Unlike the first embodiment, the first and second members 40', 41' are not identical to one-another but are substantial mirror images of one-another and can be manufactured from identical planar stampings. Intermediate portions 42', 44' are substantially divided longitudinally into an inner segment 112 and a substantially larger outer segment 114. The inner segments 112 longitudinally extend between an inner portion 116 of an intermediate edge 50' and the respective bases 46', 48'. The outer segments 114 extend longitudinally between an outer portion 118 of each intermediate edge 50' and the respective base 46', 48' and. The inner and outer portions 116, 118 of the intermediate edge 50' are substantially parallel to one-another. The inner portion 116 of the first member 40' and the inner portion 116 of the second member 41' face one-another when the terminals 12, 14 are mated. The outward convex surface of flaps 120' of the first and second member 40', 41' and the outward convex surface of the respective base 48' 46' of the second and first member 41', 40' guide the first blade 22, 16 of the second and first terminal 14, 12 into the respective recess 28, 30.

The outer portion 118 has a flap 122 which extends laterally outward and protects or covers a substantial portion of the longitudinal edge 82, 90 of the first blade 16, 22 of the first and second terminal 12, 14.

A tang 100' projects from an opposite side edge 56' of the first member 40' from the inner segment 112 of the intermediate portion 42'. The tang 100' engages the leading edge 64 of the first blade 16 of the first terminal 12. Unlike the first embodiment, a side edge 54' of the first member 40' has a tab 102' and a prong 104' projecting therefrom at the outer segment 114 of the intermediate portion 42'. The prong 104' engages the trailing edge 72 of the first blade 16 of the first terminal 12. The second member 41' also has a tang 100' protruding from the inner segment 112 and engaging the leading edge 68 of the first blade 22 of the second terminal 14. The outer segment 114 of the second member 114' has a tab 102' and a prong 104' projecting from the opposite side edge 56'. The prong 104' thereby engages a trailing edge 76 of the first blade 22 of the second terminal 14.

Figure 6:
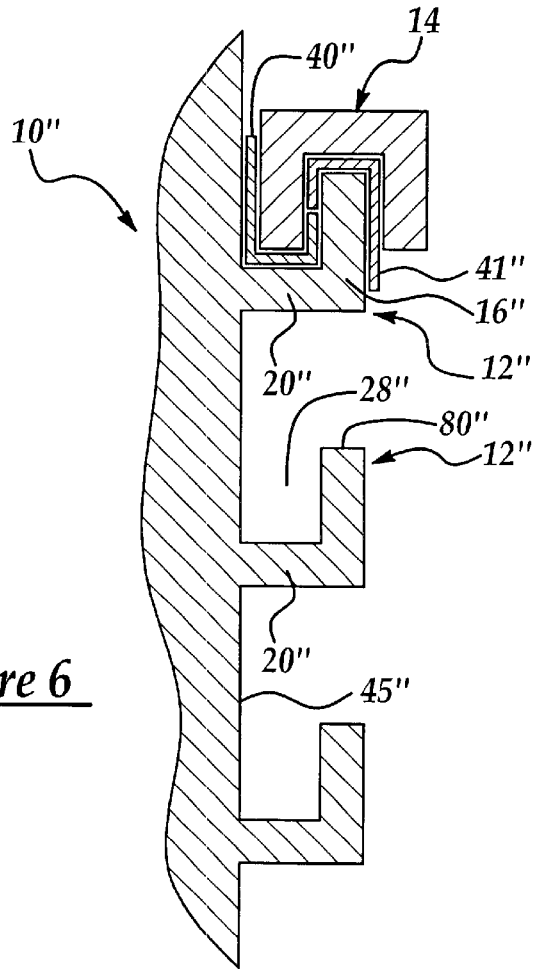
FIG. 6 is a cross section view of a third embodiment of an electrical connector.

Referring now to FIG. 6, a third embodiment of the present invention is shown wherein the first terminal 12" does not have the second blade 18 of the first and second embodiments. Instead, a series of support sections 20" project transversely from a face 45". A first blade 16" projects from the distal ends of the support sections 20" so that the first blade 16" is disposed parallel to the face 45". A recess 28" is carried between the first blade 16" and the face 45". A series of second terminals 14" mate to the series of first terminals 12" similar to that of the first embodiment.

Although the preferred embodiments of the present invention are disclosed, various changes and modifications may be made thereto to one skilled in the art without departing from the scope and spirit of the invention as set forth in the appended claims. Furthermore it is understood that the terms used herein are merely descriptive rather than limiting and various changes may be made without departing from the scope and spirit of the invention.

What is claimed is:

1. An electrical connector comprising:

a planar face;

an elongated first terminal having a recess, an elongated support section and a blade, the support section projecting laterally outward from the planar face and engaged between the planar face and the blade, the blade spaced laterally outward from the planar face, the recess defined between the planar face and the blade;

an elongated second terminal having a recess, a planar surface, and a planar blade, the surface spaced laterally outward from the blade, the recess defined laterally between the planar surface and the blade of the second terminal, the blade of the first terminal being inverted with respect to the blade of the second terminal, wherein the blade of the first terminal is disposed in the recess of the second terminal and the blade of the second terminal is disposed in the recess of the first terminal when the electrical connector is mated;

a planar S-shaped insert device having a first leg, an intermediate leg, and a second leg, the intermediate leg disposed parallel to and spaced between the first and second legs, the first leg engaged directly between the planar face and the blade of the second terminal, the intermediate leg engaged directly between the blade of the first terminal and the blade of the second terminal, the second leg engaged directly between the blade of the first terminal and the planar surface of the second terminal;

the planar blade of the elongated first terminal extending laterally with respect to the first terminal from the support section to a longitudinal edge of the planar blade of the first terminal, the insert device being disposed between the support section of the second terminal and the longitudinal edge of the planar blade of the first terminal when the electrical connector is mated;

the first terminal having a longitudinal opening to the recess disposed co-planar to the longitudinal edge of the planar blade of the first terminal and disposed perpendicular to the planar face, wherein the first leg and the intermediate leg of the insert device are inserted laterally into the recess through the longitudinal opening of the first terminal during assembly;

the planar blade of the elongated second terminal extending laterally with respect to the second terminal from the support section to a longitudinal edge of the planar blade of the second terminal, the insert device being disposed between the support section of the first terminal and the longitudinal edge of the planar blade of the second terminal when the electrical connector is mated;

the second terminal having a longitudinal opening to the recess disposed co-planar to the longitudinal edge of the planar blade of the second terminal and disposed perpendicular to the planar surface of the second terminal, wherein the second leg and the intermediate leg of the insert device are inserted laterally into the recess through the longitudinal opening of the second terminal during assembly;

a first member of the insert device having the first leg, an elongated base, and an intermediate portion;

a second member of the insert device having the second leg, an elongated base and an intermediate portion, wherein the intermediate portion of the first member and the intermediate portion of the second member are co-planar and together form the intermediate leg of the insert device;

wherein the first leg and the intermediate portion of the first member project transversely from the base toward the longitudinal opening within the recess, the elongated base of the first member disposed adjacent to the support section of the first terminal, the first member of the insert device being inserted laterally into the recess through the longitudinal opening of the first terminal during assembly, and wherein the second leg and the intermediate portion of the second member project transversely from the elongated base of the second member toward the longitudinal opening of the second terminal within the recess of the second terminal, the elongated base of the second member disposed adjacent to the support section of the second terminal, the second member of the insert device being inserted laterally into the recess of the second terminal through the longitudinal opening of the second terminal during assembly; and wherein a plurality of first terminals project rigidly from the face and wherein each one of a plurality of second terminals electrically engage a respective one of the plurality of first terminals.

2. An electrical connector comprising:

a planar face;

an elongated first terminal having a recess, an elongated support section and a blade, the support section projecting laterally outward from the planar face and engaged between the planar face and the blade, the blade spaced laterally outward from the planar face, the recess defined between the planar face and the blade;

an elongated second terminal having a recess, a planar surface, and a planar blade, the surface spaced laterally outward from the blade, the recess defined laterally between the planar surface and the blade of the second terminal, the blade of the first terminal being inverted with respect to the blade of the second terminal, wherein the blade of the first terminal is disposed in the recess of the second terminal and the blade of the second terminal is disposed in the recess of the first terminal when the electrical connector is mated;

a planar S-shaped insert device having a first leg, an intermediate leg, and a second leg, the intermediate leg disposed parallel to and spaced between the first and second legs, the first leg engaged directly between the planar face and the blade of the second terminal, the intermediate leg engaged directly between the blade of the first terminal and the blade of the second terminal, the second leg engaged directly between the blade of the first terminal and the planar surface of the second terminal;

the planar blade of the elongated first terminal extending laterally with respect to the first terminal from the support section to a longitudinal edge of the planar blade of the first terminal, the insert device being disposed between the support section of the second terminal and the longitudinal edge of the planar blade of the first terminal when the electrical connector is mated;

the first terminal having a longitudinal opening to the recess disposed co-planar to the longitudinal edge of the planar blade of the first terminal and disposed perpendicular to the planar face, wherein the first leg and the intermediate leg of the insert device are inserted laterally into the recess through the longitudinal opening of the first terminal during assembly;

the planar blade of the elongated second terminal extending laterally with respect to the second terminal from the support section to a longitudinal edge of the planar blade of the second terminal, the insert device being disposed between the support section of the first terminal and the longitudinal edge of the planar blade of the second terminal when the electrical connector is mated;

the second terminal having a longitudinal opening to the recess disposed co-planar to the longitudinal edge of the planar blade of the second terminal and disposed perpendicular to the planar surface of the second terminal, wherein the second leg and the intermediate leg of the insert device are inserted laterally into the recess through the longitudinal opening of the second terminal during assembly;

a first member of the insert device having the first leg, an elongated base, and an intermediate portion;

a second member of the insert device having the second leg, an elongated base and an intermediate portion, wherein the intermediate portion of the first member and the intermediate portion of the second member are co-planar and together form the intermediate leg of the insert device;

wherein the first leg and the intermediate portion of the first member project transversely from the base toward the longitudinal opening within the recess, the elongated base of the first member disposed adjacent to the support section of the first terminal, the first member of the insert device being inserted laterally into the recess through the longitudinal opening of the first terminal during assembly, and wherein the second leg and the intermediate portion of the second member project transversely from the elongated base of the second member toward the longitudinal opening of the second terminal within the recess of the second terminal, the elongated base of the second member disposed adjacent to the support section of the second terminal, the second member of the insert device being inserted laterally into the recess of the second terminal through the longitudinal opening of the second terminal during assembly;

the first terminal having a second blade defining the face, the first and second blades projecting transversely from the elongated support section;

the second terminal having a second blade and an elongated support section, the second blade defining the surface, the first and second blades projecting transversely from the elongated support section of the second terminal, the support section extended laterally between the first and second blades of the second terminal;

wherein the first terminal is identical to the second terminal and the first blade is identical to the second blade, and wherein the first and second terminals are each a terminal;

the terminal having a leading and a trailing opening to the recess;

the first and second blades of the terminal each having a leading edge and a trailing edge, the leading opening defined between the leading edges and the trailing opening defined between the trailing edges, the first and second blades extended longitudinally to the terminal between the respective leading and trailing edges;

the leading and trailing edges of the first and second blades each defining a notch;

the first and second members of the insert device each having a side edge, an end edge, a tab, and a prong, the tab disposed between the elongated base and the end edge and disposed nearest the base, the tab being engaged between the side edge and the prong, the tab projecting outward from the side edge;

the prong of the side edge of the first member disposed perpendicular to the tab and projecting away from the base and toward the end edge, the prong engaged to the notch of the trailing edge of the second blade of the first terminal; and the prong of the second member engaged to the notch of the leading edge of the first blade of the second terminal.

3. The electrical connector set forth in claim 2 wherein the first and second members have an opposite side edge, an opposite tab, and an opposite prong, the opposite tab disposed near the connecting portion and engaged between the opposite side edge and the opposite prong, the opposite tab projecting outward from the opposite side edge, the opposite prong disposed perpendicular to the opposite tab and projecting away from the base, the opposite prong of the first member being engaged to the notch of the leading edge of the second blade of the first terminal, and the opposite prong of the second member being engaged to the notch of the trailing edge of the first blade of the second terminal when assembled.

4. The electrical connector set forth in claim 3 wherein the first member is identical to the second member, the first and second members each being a member.

5. The electrical connector set forth in claim 4 wherein the intermediate portion of the member extends from the side edge to the opposite side edge.

6. The electrical connector set forth in claim 5 wherein the member has a plurality of resilient inward bent ribs extending longitudinally with respect to the base between the side edge and the opposite side edge of the leg and the intermediate portion, and wherein the second terminal inserts into the first terminal from a longitudinal direction.

7. The electrical connector set forth in claim 6 wherein the intermediate leg of the insert device is bisected longitudinally along an intermediate edge of the members, the intermediate edge being parallel to the plurality of ribs and extending lengthwise between the side edge to the opposite side edge.

8. The electrical connector set forth in claim 7 further comprising:

the first member having a tang engaged to the intermediate portion and projecting outward from the side edge, the tang being bent laterally outward and engaged to the trailing edge of the first blade of the first terminal; and the second member having a tang engaged to the intermediate portion and projecting outward from the side edge, the tang being bent laterally outward and engaged to the leading edge of the first blade of the second terminal.

9. The electrical connector set forth in claim 8 further comprising:

the first member having an opposite tang engaged to the intermediate portion and projecting outward from the opposite side edge, the opposite tang being bent laterally outward and engaged to the leading edge of the first blade of the first terminal; and the second member having an opposite tang engaged to the intermediate portion and projecting outward from the opposite side edge, the opposite tang being bent laterally outward and engaged to the trailing edge of the first blade of the second terminal.

10. An electrical connector comprising:

a planar face;

an elongated first terminal having a recess, an elongated support section and a blade, the support section projecting laterally outward from the planar face and engaged between the planar face and the blade, the blade spaced laterally outward from the planar face, the recess defined between the planar face and the blade;

an elongated second terminal having a recess, a planar surface, and a planar blade, the surface spaced laterally outward from the blade, the recess defined laterally between the planar surface and the blade of the second terminal, the blade of the first terminal being inverted with respect to the blade of the second terminal, wherein the blade of the first terminal is disposed in the recess of the second terminal and the blade of the second terminal is disposed in the recess of the first terminal when the electrical connector is mated;

a planar S-shaped insert device having a first leg, an intermediate leg, and a second leg, the intermediate leg disposed parallel to and spaced between the first and second legs, the first leg engaged directly between the planar face and the blade of the second terminal, the intermediate leg engaged directly between the blade of the first terminal and the blade of the second terminal, the second leg engaged directly between the blade of the first terminal and the planar surface of the second terminal;

the planar blade of the elongated first terminal extending laterally with respect to the first terminal from the support section to a longitudinal edge of the planar blade of the first terminal, the insert device being disposed between the support section of the second terminal and the longitudinal edge of the planar blade of the first terminal when the electrical connector is mated;

the first terminal having a longitudinal opening to the recess disposed co-planar to the longitudinal edge of the planar blade of the first terminal and disposed perpendicular to the planar face, wherein the first leg and the intermediate leg of the insert device are inserted laterally into the recess through the longitudinal opening of the first terminal during assembly;

the planar blade of the elongated second terminal extending laterally with respect to the second terminal from the support section to a longitudinal edge of the planar blade of the second terminal, the insert device being disposed between the support section of the first terminal and the longitudinal edge of the planar blade of the second terminal when the electrical connector is mated;

the second terminal having a longitudinal opening to the recess disposed co-planar to the longitudinal edge of the planar blade of the second terminal and disposed perpendicular to the planar surface of the second terminal, wherein the second leg and the intermediate leg of the insert device are inserted laterally into the recess through the longitudinal opening of the second terminal during assembly;

a first member of the insert device having the first leg, an elongated base, and an intermediate portion;

a second member of the insert device having the second leg, an elongated base and an intermediate portion, wherein the intermediate portion of the first member and the intermediate portion of the second member are co-planar and together form the intermediate leg of the insert device; and wherein the first and second legs of the insert device each have a flap projecting from the end edge and over the second blade of the first and second terminals.

11. An electrical connector comprising:

a planar face;

an elongated first terminal having a recess, an elongated support section and a blade, the support section projecting laterally outward from the planar face and engaged between the planar face and the blade, the blade spaced laterally outward from the planar face, the recess defined between the planar face and the blade;

an elongated second terminal having a recess, a planar surface, and a planar blade, the surface spaced laterally outward from the blade, the recess defined laterally between the planar surface and the blade of the second terminal, the blade of the first terminal being inverted with respect to the blade of the second terminal, wherein the blade of the first terminal is disposed in the recess of the second terminal and the blade of the second terminal is disposed in the recess of the first terminal when the electrical connector is mated;

a planar S-shaped insert device having a first leg, an intermediate leg, and a second leg, the intermediate leg disposed parallel to and spaced between the first and second legs, the first leg engaged directly between the planar face and the blade of the second terminal, the intermediate leg engaged directly between the blade of the first terminal and the blade of the second terminal, the second leg engaged directly between the blade of the first terminal and the planar surface of the second terminal;

the planar blade of the elongated first terminal extending laterally with respect to the first terminal from the support section to a longitudinal edge of the planar blade of the first terminal, the insert device being disposed between the support section of the second terminal and the longitudinal edge of the planar blade of the first terminal when the electrical connector is mated;

the first terminal having a longitudinal opening to the recess disposed co-planar to the longitudinal edge of the planar blade of the first terminal and disposed perpendicular to the planar face, wherein the first leg and the intermediate leg of the insert device are inserted laterally into the recess through the longitudinal opening of the first terminal during assembly;

the planar blade of the elongated second terminal extending laterally with respect to the second terminal from the support section to a longitudinal edge of the planar blade of the second terminal, the insert device being disposed between the support section of the first terminal and the longitudinal edge of the planar blade of the second terminal when the electrical connector is mated;

the second terminal having a longitudinal opening to the recess disposed co-planar to the longitudinal edge of the planar blade of the second terminal and disposed perpendicular to the planar surface of the second terminal, wherein the second leg and the intermediate leg of the insert device are inserted laterally into the recess through the longitudinal opening of the second terminal during assembly;

a first member of the insert device having the first leg, an elongated base, and an intermediate portion;

a second member of the insert device having the second leg, an elongated base and an intermediate portion, wherein the intermediate portion of the first member and the intermediate portion of the second member are co-planar and together form the intermediate leg of the insert device;

wherein the first leg and the intermediate portion of the first member project transversely from the base toward the longitudinal opening within the recess, the elongated base of the first member disposed adjacent to the support section of the first terminal, the first member of the insert device being inserted laterally into the recess through the longitudinal opening of the first terminal during assembly, and wherein the second leg and the intermediate portion of the second member project transversely from the elongated base of the second member toward the longitudinal opening of the second terminal within the recess of the second terminal, the elongated base of the second member disposed adjacent to the support section of the second terminal, the second member of the insert device being inserted laterally into the recess of the second terminal through the longitudinal opening of the second terminal during assembly;

the first terminal having a second blade defining the face, the first and second blades projecting transversely from the elongated support section;

the second terminal having a second blade and an elongated support section, the second blade defining the surface, the first and second blades projecting transversely from the elongated support section of the second terminal, the support section extended laterally between the first and second blades of the second terminal;

wherein the first terminal is identical to the second terminal and the first blade is identical to the second blade, and wherein the first and second terminals are each a terminal;

the terminal having a leading and a trailing opening to the recess;

the first and second blades of the terminal each having a leading edge and a trailing edge, the leading opening defined between the leading edges and the trailing opening defined between the trailing edges, the first and second blades extended longitudinally to the terminal between the respective leading and trailing edges;

the leading and trailing edges of the first and second blades each defining a notch;

the first and second members of the insert device each having a side edge, an end edge, a tab, and a prong, the tab disposed between the elongated base and the end edge and disposed nearest the base, the tab being engaged between the side edge and the prong, the tab projecting outward from the side edge;

the prong of the side edge of the first member disposed perpendicular to the tab and projecting away from the base and toward the end edge, the prong engaged to the notch of the trailing edge of the second blade of the first terminal;

the prong of the second member engaged to the notch of the leading edge of the first blade of the second terminal;

wherein the first and second members have an opposite side edge, an opposite tab, and an opposite prong, the opposite tab disposed near the connecting portion and engaged between the opposite side edge and the opposite prong, the opposite tab projecting outward from the opposite side edge, the opposite prong disposed perpendicular to the opposite tab and projecting away from the base, the opposite prong of the first member being engaged to the notch of the leading edge of the second blade of the first terminal, and the opposite prong of the second member being engaged to the notch of the trailing edge of the first blade of the second terminal when assembled; and wherein the intermediate leg of the insert device is semi-bisected longitudinally with respect to the intermediate leg, the intermediate edge having an outer portion and a parallel inner portion.

12. The electrical connector set forth in claim 11 further comprising:

the first and second members each having a plurality of resilient inward bent ribs extending laterally with respect to the elongated base and disposed between the base and the end edge of the first and second legs; and wherein the first terminal is mated to the second terminal from a lateral direction.

13. The electrical connector set forth in claim 12 further comprising:

the intermediate portion having an outer segment and an adjacent inner segment, the outer segment defined by the outer portion of the intermediate edge, the inner segment defined by the inner portion of the intermediate edge; and a tang engaged to the inner segment of the intermediate portion of the first and second members, the tang of the second member projecting outward from the side edge, the tang of the first member projecting outward from the opposite side edge, the tangs being bent laterally outward and engaged to the leading edge of the first blades of the terminals.

14. The electrical connector set forth in claim 13 further comprising:

the outer segment of the intermediate portion of the first and second members having a tab, and a prong, the tab disposed near the base and engaged between the opposite side edge and the prong, the tab projecting outward from the opposite side edge, the prong disposed perpendicular to the tab and projecting away from the base; and the prong of the outer segment of the intermediate portion of the first and second members engaged to the notch of the trailing edge of the first blade of the first and second terminals.

* * * * *